United States Patent [19]

Rapp

[11] Patent Number: 4,522,315

[45] Date of Patent: Jun. 11, 1985

[54] CLOSURE CAP FOR MULTI-COMPARTMENT CONTAINERS

[75] Inventor: Karl G. Rapp, Iserlohn, Fed. Rep. of Germany

[73] Assignee: United Industries Sales Organization, Inc., North Miami, Fla.

[21] Appl. No.: 350,568

[22] Filed: Feb. 22, 1982

[30] Foreign Application Priority Data

Nov. 20, 1981 [DE] Fed. Rep. of Germany ... 8133868[U]

[51] Int. Cl.[3] ..... A47G 19/24

[52] U.S. Cl. ..... 222/142.1; 222/565

[58] Field of Search ..... 222/142.1–142.9, 222/144.5, 480, 565; 221/69; 206/538

[56] References Cited

U.S. PATENT DOCUMENTS

| | | | |
|---|---|---|---|
| 212,827 | 11/1968 | D'Elia et al. . | |
| 1,033,688 | 9/1912 | Fuchs . | |
| 1,033,689 | 7/1912 | Fuchs | 222/142.1 |
| 2,182,623 | 12/1939 | Dolar . | |
| 3,140,019 | 9/1964 | Barr . | |
| 3,262,606 | 7/1966 | Waterman | 222/480 X |
| 3,836,056 | 9/1974 | Pehr | 222/565 X |
| 3,850,350 | 11/1974 | Towns et al. . | |
| 4,163,496 | 8/1979 | Dogliotti | 206/538 |
| 4,310,105 | 1/1982 | Gach . | |
| 4,369,901 | 1/1983 | Hidding | 222/142.7 X |

FOREIGN PATENT DOCUMENTS

| | | | |
|---|---|---|---|
| 1006526 | 4/1952 | France | 222/565 |
| 597806 | 4/1978 | Switzerland | 222/142.8 |

*Primary Examiner*—F. J. Bartuska

*Attorney, Agent, or Firm*—Burns, Doane, Swecker & Mathis

[57] ABSTRACT

A dispensing closure cap for a multi-compartment container comprises a body releasably mountable on the container in sealing engagement therewith and having a top wall in which is formed at least one dispensing opening for each of the container compartments; and a non-rotatable lid assembly mounted on the cap body having a lid for each compartment pivotably connected to a central mounting member.

12 Claims, 8 Drawing Figures

Fig. 6
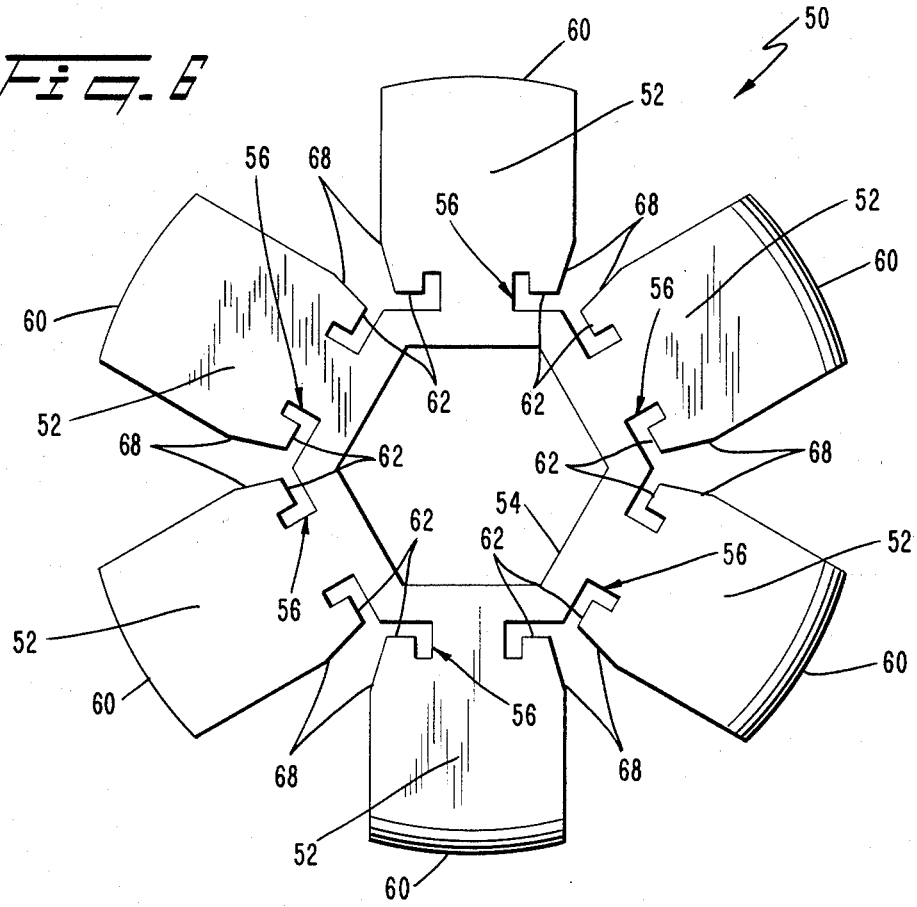
Fig. 7
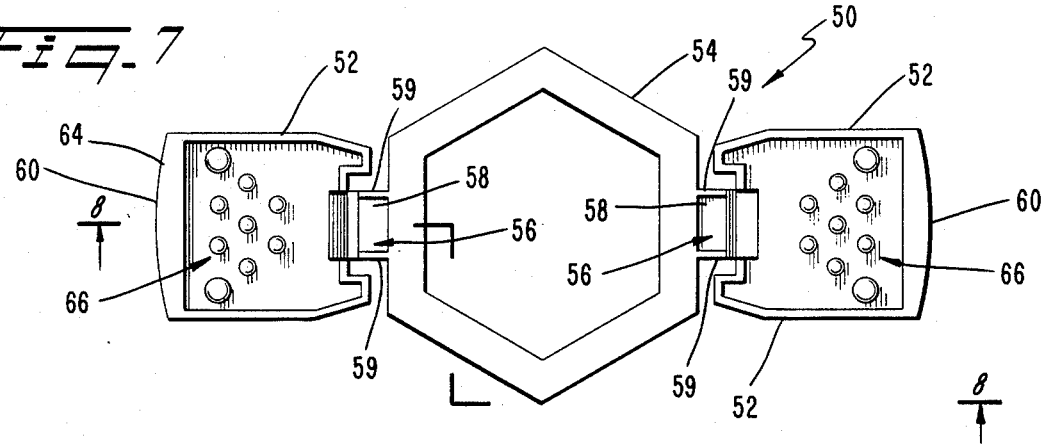
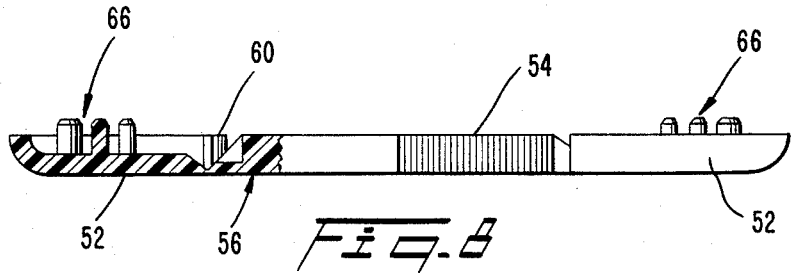
Fig. 8

CLOSURE CAP FOR MULTI-COMPARTMENT CONTAINERS

FIELD OF THE INVENTION

The present invention relates in general to closure caps for containers, and in particular to removable dispensing closure caps for multi-compartment containers.

BACKGROUND OF THE INVENTION

Multi-compartment dispensing containers have proven quite popular for such items as kitchen spices and the like, since they provide busy cooks with ready access to the most frequently used spices. One such container which has been commercially available has a rotatable lid which allows dispensing openings for each compartment to be selectively opened by rotating the lid. However, rotating lids suffer from a significant disadvantage because residues on the lid are transported to other compartments, contaminating the contents thereof.

SUMMARY OF THE INVENTION

This and other disadvantages of the prior art are overcome by the dispensing closure cap of the present invention, which comprises a body mountable on the container in sealing engagement therewith and having a top wall in which is formed at least one dispensing opening for each of the container compartments, and a non-rotatable lid assembly mounted on the cap body having a lid for each compartment pivotably connected to a central mounting member.

In accordance with one aspect of the invention the top wall of the cap body comprises a central raised, preferably polygonal, hub on which the mounting member is mounted. The mounting member preferably comprises a polygonal ring-shaped member such that the mounting member is mounted on the hub in mating relationship therewith.

In accordance with another aspect of the present invention, the mounting member is flexible and the side walls of the hub taper inwardly from top to bottom such that the mounting member is releasably mounted on the hub in snap-fit relationship therewith.

In accordance with still another aspect of the present invention, each lid of the lid assembly is spaced from the mounting member and connected thereto by a flexible hinge assembly. Preferably, the lid assembly is an integral one-piece unit and each hinge assembly comprises a leg member connecting the corresponding lid and mounting member and a pivot joint formed by weakening the junction between the corresponding leg member and lid. Advantageously, the lid assembly is made of plastic and each pivot joint is formed by a V-shaped crimp in the corresponding junction.

In accordance with a still further aspect of the present invention, the cap body top wall further comprises a plurality of raised sections spaced from the hub and disposed such that the lids fit between adjacent raised sections when the lids are in a closed position. Further, the raised sections and lids advantageously have the same thickness such that the lids are flush with the raised sections when the lids are in the closed position.

In accordance with another aspect of the present invention, the underside of the cap body top wall comprises a groove for receiving the upper edges of partitions defining the container compartments to seal the compartments from one another.

In accordance with another aspect of the present invention, the cap body is cylindrical and the side wall thereof has a stepped inner surface defining a first lower section having a first diameter and a second, upper section having a second diameter. The second diameter corresponds to the outside diameter of the container such that the second inner surface section is in sealing engagement with the container when the cap is mounted on the container. Further, the sidewall second inner surface advantageously is formed with at least one circumferential raised sealing ring.

Advantageously, a set of two sealing rings equidistantly spaced from a circumferential intermediate groove are provided, as well as a further sealing ring spaced from the set of sealing rings adjacent the top wall.

A cap constructed in accordance with the present invention prevents contamination of the contents of multi-compartment containers, yet is simple to use. Further, such caps are readily and economically mass-produced. In addition, the lid assembly is easily removed to facilitate complete cleaning of the cap.

These and other features and advantages of the present invention will be disclosed in or apparent from the following detailed description of a preferred embodiment.

BRIEF DESCRIPTION OF THE DRAWING

The preferred embodiment will be described with reference to the drawing, in which:

FIG. 6 is a top plan view of the lid assembly.

FIG. 7 is a simplified bottom plan view of a representative portion of the lid assembly.

FIG. 8 is a partial sectional side elevation view of the lid assembly.

DETAILED DESCRIPTION OF A PREFERRED EMBODIMENT

Referring to the figures, a dispensing closure cap constructed in accordance with the present invention is generally denoted 10 and a multi-compartment container for which cap 10 is adapted is generally denoted 12.

Figure 1:
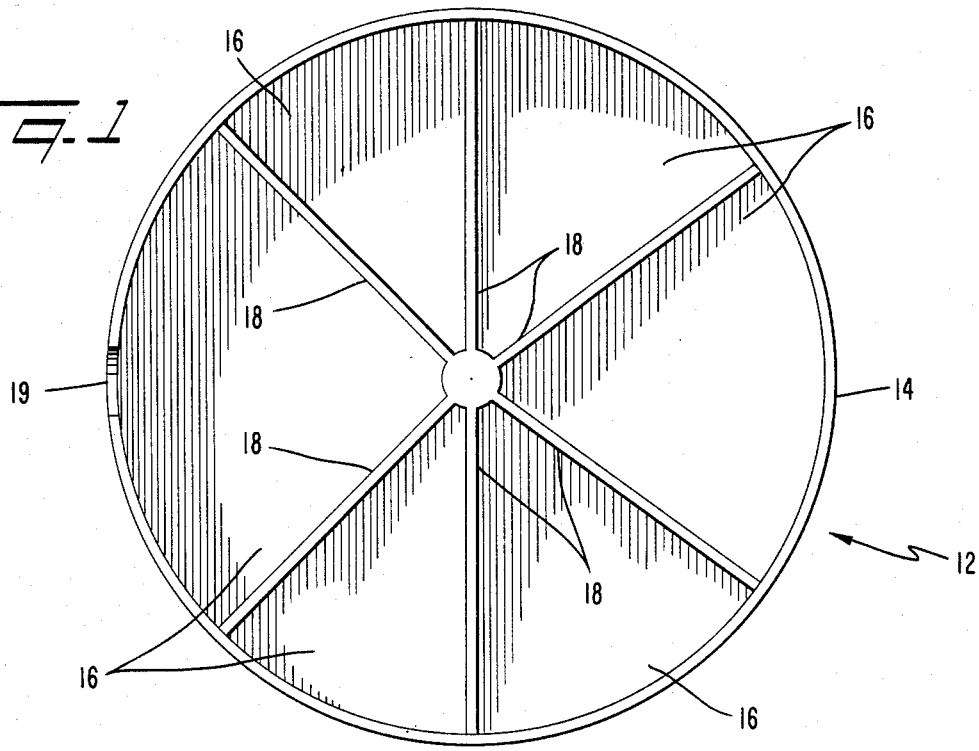
FIG. 1 is a top plan view of a container for which the preferred embodiment is adapted.

Referring specifically to FIG. 1, container 12 is generally cylindrical and has a side wall 14, the top edge 16 of which defines an open mouth for the container. The interior of container 12 is divided into a plurality of compartments 16 by radially oriented and longitudinally extending partitions 18. As shown, compartments 16 advantageously are of different sizes, and container edge 16 is formed with an orienting slot 19 which cooperates with cap 10 as will be described in more detail hereinbelow.

Referring generally to FIGS. 2–8, cap 10 comprises a body, generally denoted 20, mountable on container 12 in sealing engagement therewith for closing the container mouth, and a non-rotatable lid assembly, generally denoted 50, mounted on body 20.

Referring specifically to FIGS. 2–5, cap body 20 has a top wall 22 and a side wall 24. At least one dispensing opening 26 is formed in top wall 22 adjacent the periphery thereof for each of the container compartments. Preferably, as shown, a plurality of spaced openings 26 are provided for each compartment. The openings 26 advantageously are arranged in straight rows which are relatively circumferentially oriented, and the openings in each row are staggered with respect to the openings in adjacent rows. Preferably, as shown, the two end openings 26' in the radially outermost row are larger than the remaining holes.

Top wall 22 of cap body 20 further comprises a central, raised, preferably polygonal hub 28 formed on the top or exterior surface of top wall 22. Lid assembly 50 is mounted on hub 28 as will be described in more detail hereinbelow.

A plurality of raised sections 30 are also formed on the top surface of cap body top wall 22. Raised sections 30 preferably are spaced from hub 28, and are disposed around the periphery of top wall 22 and alternate with openings 26. As shown, for a six compartment container, sections 30 advantageously are triangular, with the vertices pointing radially inwardly, and hub 28 is hexagonal and oriented such that the vertices thereof are aligned with the respective vertices of sections 30, as shown.

Figure 3:
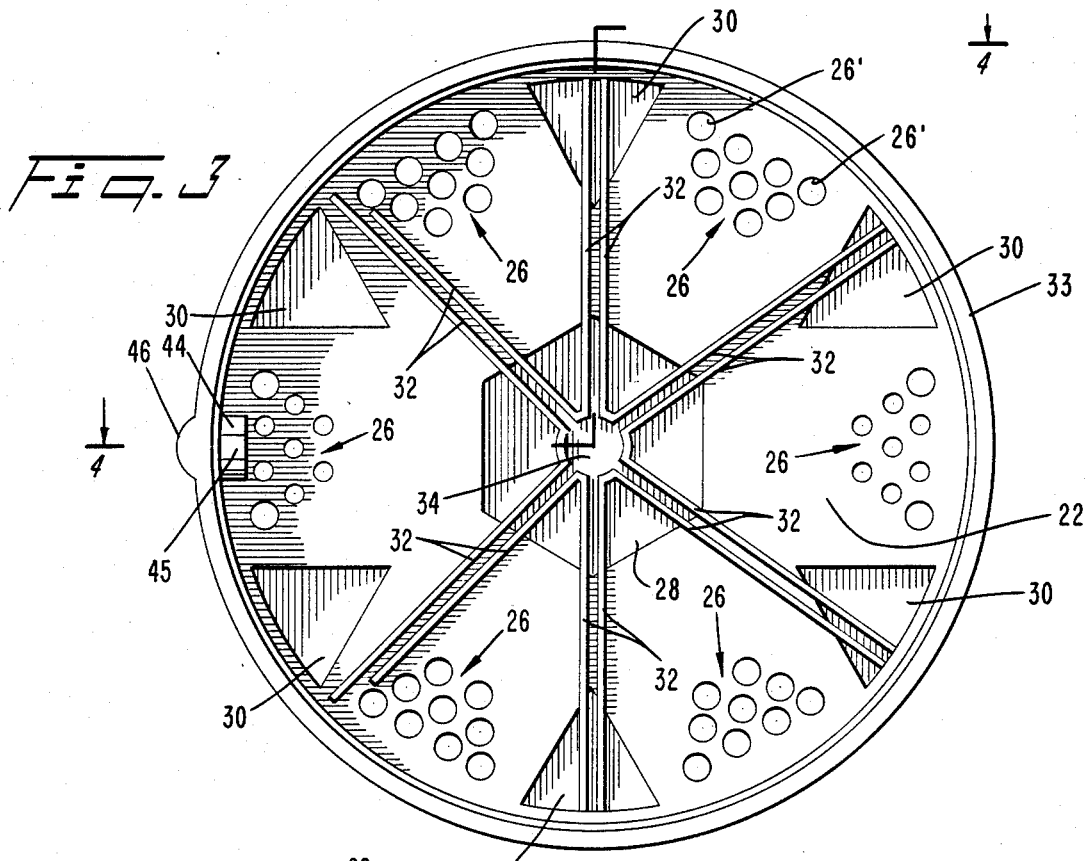
FIG. 3 is a bottom plan view of the cap body.

As shown in FIG. 3, the inner or bottom surface of cap body top wall 20 is formed with a plurality of rails 32 which form a star-shaped groove 34 which receives the top edges of container partitions 18 when cap 10 is mounted on container 12 and thereby seals compartments 16 from one another. The inner surface of top wall 20 is also formed so as to define a peripheral rim 33 which abuts container top edge 16 when cap 10 is mounted on container 12.

Figure 4:
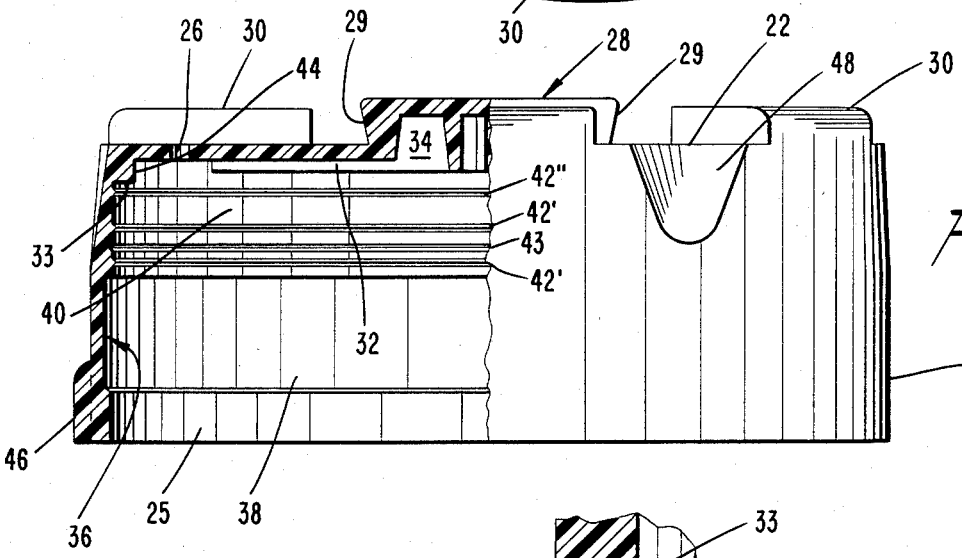
FIG. 4 is sectional side elevation view, with details omitted for clarity, of the cap body taken along the line 4—4 in FIG. 3.

As shown in FIGS. 3 and 4, cap body side wall 24 has a stepped inner surface, generally denoted 36, which defines a first, lower section 38 having a first diameter and a second upper section 40 having a second diameter smaller than the aforesaid first diameter. The diameter of upper section 40 corresponds to the outside diameter of container 12, such that upper section 40 of side wall inner surface 36 is in sealing engagement with container 12 when cap 10 is mounted thereon. Cap body side wall 24 preferably also is provided with a thickened lower rim 25 for stiffening reinforcement. Rim 25 advantageously projects inwardly, as shown in FIG. 4, and has an inner diameter which is greater than the aforesaid second diameter of section 40.

Figure 5:
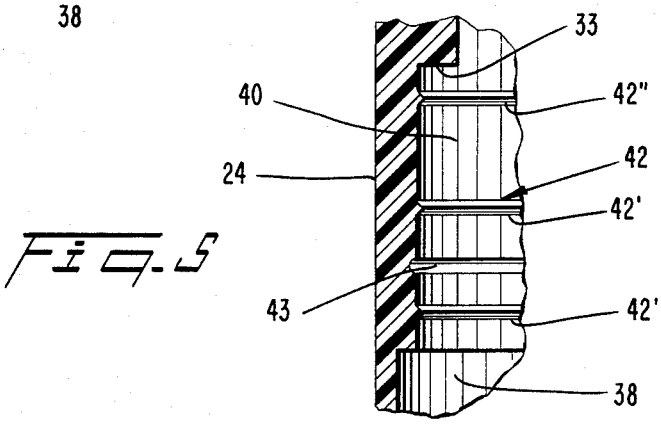
FIG. 5 is an enlarged detail sectional side elevation view of a portion of the cap body side wall.

Referring to FIG. 5, cap 10 advantageously is made of plastic and inner surface upper section 40 advantageously is formed with at least one circumferential raised sealing ring 42. Preferably, as shown, three sealing rings 42 are provided. The two lower rings 42' are spaced equidistantly from a circumferential intermediate groove 43, and the uppermost ring 42'', nearest top wall 20, is spaced further from the nearest lower ring 42' than the rings 42' are spaced from groove 43. As shown, rings 42 advantageously have a triangular transverse cross-section with the projecting vertex having an angle of 90°.

A key member 44 which projects outwardly from the junction of the bottom surface of top wall 22 and the inner surface of side wall 24 at a predetermined location is advantageously provided when container compartments 16 are not of uniform size. Key member 44 cooperates with slot 19 in the upper edge of container 12 when cap 10 is mounted thereon to orient cap groove 34 with container partitions 18. As shown, the lower surface 45 of key member 44 advantageously is chamfered to facilitate mating of member 44 with slot 19. Further, a section of the outer surface of side wall 24 advantageously is raised adjacent the lower rim to form a bump 46 in alignment with key member 44 to aid the user in properly aligning cap 10 with container 12 when cap 10 is being mounted thereon.

Figure 2:
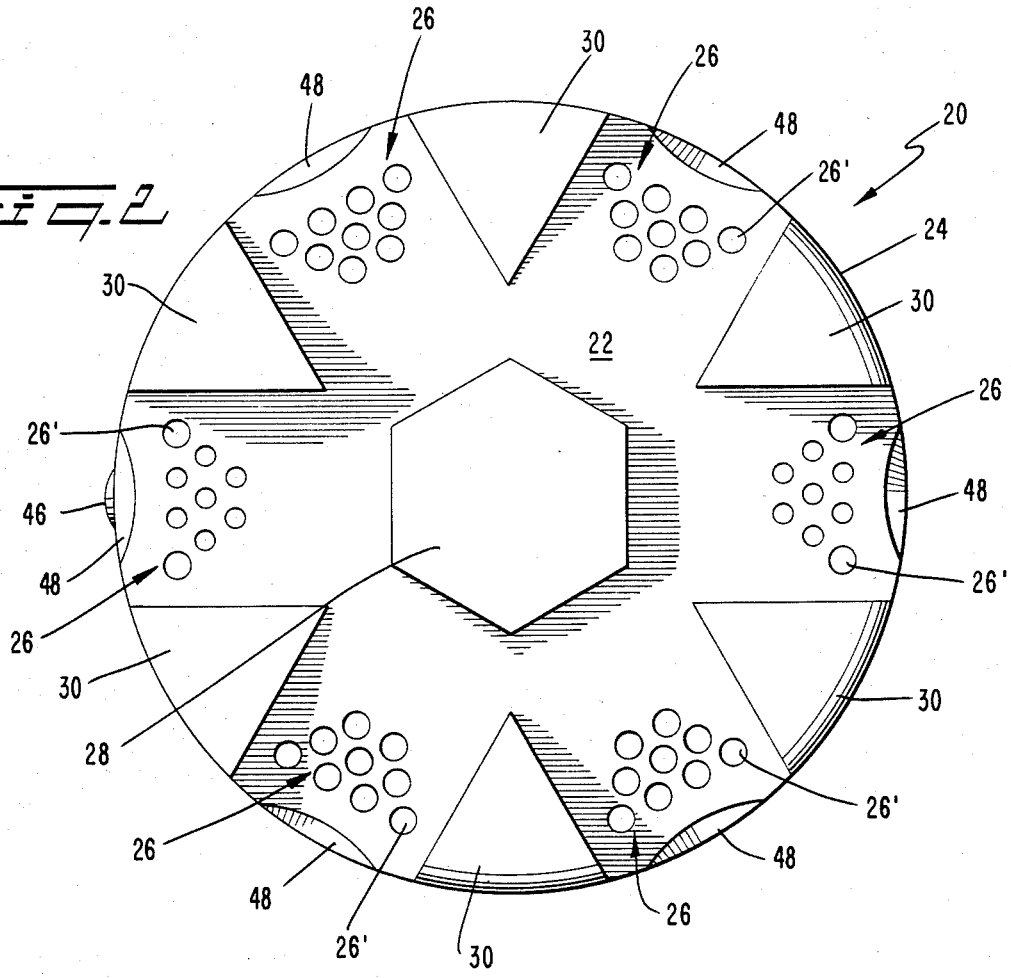
FIG. 2 is a top plan view of the cap body.

As shown in FIGS. 2 and 4, the outer surface of side wall 24 advantageously is formed with a plurality of shallow depressions or recesses 48 around the upper rim in alignment with the openings 26. As will be more apparent from the following description of lid assembly 50, recesses 48 facilitate opening of lids 52 by a user.

Referring specifically to FIGS. 6–8, lid assembly 50 comprises a lid 52 for each at least one dispensing opening 26/container compartment 16, and a central mounting member 54 to which each lid 52 is pivotably connected.

As shown, mounting member 54 preferably is a polygonal ring-shaped member which mounts on hub 28 of cap body 22 in mating relationship therewith. Preferably, lid assembly 50 is made of plastic and mounting member 54 is slightly flexible. Further, the side walls 29 of hub 28 taper inwardly slightly from top to bottom, as shown in FIG. 4, such that mounting member 54 is releasably mounted on hub 28 in snap-fit relationship therewith.

Each lid 52 advantageously is spaced from mounting member 54 and is connected thereto by a flexible hinge assembly, generally denoted 56. Preferably, lid assembly 50 is an integral one-piece unit of molded plastic, and each hinge assembly 56 comprises a leg member 58 connecting the corresponding lid 52 to mounting member 54 and a pivot joint 60 formed by weakening the junction between the corresponding lid 52 and leg member 58. Advantageously, pivot-joint 60 is formed by a V-shaped crimp in the aforementioned junction. Each leg 58 advantageously comprises depending triangular side walls 59 adjacent mounting member 54, as shown, for reinforcement.

Each lid 52 advantageously is generally rectangular, with the outer edge 60 slightly curved, as shown, to conform with the contour of cap body 20. Each lid 52 advantageously is further configured to define two leg portions 62 extending toward mounting member 54 with one leg portion 62 on either lateral side of the corresponding leg member 58 and in spaced relationship therewith. As shown in FIG. 7, each lid 52 further is formed with a rim 64 depending from the bottom surface thereof. Rim 64 extends around the periphery of the lid, and terminates at the corresponding pivot joint 60, as shown. At least one pin 66 projects from the bottom of each lid for mating with the corresponding at least one opening 26 in cap body 20 when the lid is in a closed position, thereby sealing the opening. As shown, the sides 68 of each lid advantageously taper inwardly toward each other in the vicinity of leg portions 62. Lids 52 are dimensioned to fit flush between adjacent raised sections 30 when lids 52 are in the closed position thereof.

The operation of a cap constructed in accordance with the present invention should be apparent from the foregoing. Mounting member 54 of lid assembly 50 is mounted on hub 28 of cap body 20. Due to the polygonal configurations of mounting member 54 and hub 28, lid assembly 50 is non-rotatable. Lids 52 extend symmetrically outwardly from mounting member 54 in registry with the dispensing openings 26 in cap body 20. It will be appreciated that the sets of openings 26 for the container compartments 16 can be equidistantly circumferentially spaced from each other around top wall 22 of cap body 20 even though compartments 16 are not of equal size because the compartments are sealed off by the seating of partitions 18 in groove 34 on the underside of cap body 20. A lid 52 is in a closed position when the corresponding hinge assembly 56 is flat and lid 52 thus extends straight outwardly from mounting member 54. As noted above, the pins 66 of each lid 52 are inserted in the corresponding dispensing openings 26 when the lid is closed, thereby sealing the openings. A lid 52 is opened by pressing upwardly on the bottom portion thereof which is exposed by the corresponding recess 48 in cap body side wall 24, thereby causing hinge assembly 56 to bend. Since a different lid 52 is used for each compartment 16, there is no danger of contamination of the contents of the compartments as is the case with rotating lid caps. Cap 10 is mounted on container 12 simply by pressing the two together with cap key member 44 in registry with container slot 19. Cap 10 is securely held on container 12 by the sealing ring arrangement described hereinabove.

It will be appreciated that the cap of the present invention is advantageously made simply and economically entirely of plastic using conventional plastic molding techniques.

It will be further appreciated that the present invention is not limited to the preferred embodiment described hereinabove, and that changes and modifications can be made without departing from the scope or spirit of the invention.

I claim:

1. A dispensing closure cap for a container having a plurality of compartments communicating with an open mouth of said container, said cap comprising:

a body mountable on the container in sealing engagement therewith for closing the container mouth;

a top wall defined by said body including a central raised hub and at least one dispensing opening for each of the container compartments;

a non-rotatable lid assembly mounted on said cap body comprising a lid for each at least one dispensing opening pivotably connected to a central mounting means comprising a polygonal ring-shaped member; and, a corresponding polygonal configuration provided on said hub so that said mounting member is mounted on said hub in a mating relationship, said mounting member provided as a flexible member and said hub is provided with side walls which taper inwardly from top to bottom such that said mounting member is releasably mounted on said hub in a snap-fit relationship therewith;

said lid assembly is provided as an integral one-piece unit made of plastic with each lid spaced from said mounting member and connected thereto by flexible hinge means, each hinge means comprises a leg member connecting the corresponding lid and said mounting member and including a pivot joint defined at a junction between the corresponding leg member and lid and formed by a V-shaped crimp in the junction;

each said leg member comprising depending triangular side walls adjacent said mounting member so as to reinforce the leg member;

said cap body removably mounted on the container and provided with a generally cylindrical shape defining a circular sidewall, said side wall having a stepped inner surface defining a first, lower section having a first diameter and a second, upper section having a second diameter, said second diameter corresponding to the outside diameter of the container such that said second inner surface section is in sealing engagement with the container when said cap is mounted on the container, said first diameter being larger than said second diameter.

2. The cap of claim 1 wherein each lid comprises a leg portion extending toward said mounting member on both lateral sides of the corresponding leg member and in spaced relationship therewith.

3. The cap of claim 1 wherein each lid further comprises a rim depending from the bottom surface thereof and extending around the periphery of the lid and terminating at the corresponding junction crimp.

4. The cap of claim 1 wherein said body top wall is formed with a plurality of spaced dispensing openings for each container compartment arranged in rows with the openings in each row staggered with respect to the openings in adjacent rows, and the two end openings in the outermost row being larger than the remaining holes, and wherein each of said lids comprises a plurality of depending pins for mating with the corresponding plurality of dispensing openings when the lid is in a closed position.

5. The cap of claim 1 wherein said cap body top wall further comprises a plurality of raised sections spaced from said hub and disposed such that said lids fit between adjacent raised sections when said lids are in a closed position, said raised sections further having the same thickness as said lids such that said lids are flush with said raised sections when said lids are in said closed position.

6. The cap of claim 5 wherein said lid assembly has six generally rectangular lids and said raised sections are generally triangular.

7. The cap of claim 6 wherein the sides of each lid taper inwardly toward each other in the vicinity of said leg portions.

8. The cap of claim 1 wherein the container comprises a plurality of partitions having upper edges which terminate at the container mouth, and the bottom surface of said cap body top wall comprises groove means for receiving the partition upper edges when said cap is mounted on the container to seal the compartments from one another.

9. The cap of claim 1 wherein said cap body is made of plastic and said side wall second inner surface section is formed with at least one circumferential raised sealing ring.

10. The cap of claim 9 wherein said side wall second inner surface is formed with a set of two sealing rings equidistantly spaced from a circumferential intermediate groove and a further sealing ring spaced from said set of sealing rings adjacent said top wall.

11. The cap of claim 10 wherein said further ring is spaced further from the nearest one of said set of rings then the rings of said set of rings are spaced from said groove; and wherein said rings have a triangular transverse cross-section.

12. The cap of claim 9 wherein the upper edge of the container defining the mouth is formed with a slot and said side wall second inner surface is formed with a key member which cooperates with the container slot to ensure mounting of said cap on the container in a predetermined orientation.

* * * * *